US005853295A

United States Patent [19]

Rosenberger

[11] Patent Number: 5,853,295

[45] Date of Patent: Dec. 29, 1998

[54] ANGLE CONNECTOR BETWEEN A COAXIAL STRUCTURE AND A PLANAR STRUCTURE

[75] Inventor: Bernd Rosenberger, Tittmoning, Germany

[73] Assignee: Rosenberger Hochfrequenztechnik GmbH & Co., Tittmoning, Germany

[21] Appl. No.: 740,673

[22] Filed: Oct. 31, 1996

[30] Foreign Application Priority Data

Oct. 31, 1995 [DE] Germany ..... 195 40 614.1

[51] Int. Cl.[6] ..... H01R 9/09

[52] U.S. Cl. ..... 439/63; 333/33

[58] Field of Search ..... 439/63, 581, 79; 333/33, 34, 260

[56] References Cited

U.S. PATENT DOCUMENTS

| | | | |
|---|---|---|---|
| 4,605,269 | 8/1986 | Cohen et al. | 439/63 |
| 5,061,192 | 10/1991 | Chapin et al. | 439/66 |
| 5,136,271 | 8/1992 | Nishioka et al. | 333/246 |
| 5,402,088 | 3/1995 | Pierro et al. | 333/33 |

*Primary Examiner*—Neil Abrams
*Assistant Examiner*—Barry M. L. Standig
*Attorney, Agent, or Firm*—Lowe Hauptman Gopstein Gilman & Berner

[57] ABSTRACT

An angle connector electrically connects a planar structure to a coaxial structure, wherein a planar-side terminal is designed as a planar waveguide connected within an outer periphery of the angle connector to the coax-side terminal.

17 Claims, 5 Drawing Sheets

ANGLE CONNECTOR BETWEEN A COAXIAL STRUCTURE AND A PLANAR STRUCTURE

TECHNICAL FIELD

The present invention relates to an angle connector and more particularly to an angle connector for connecting planar and coaxial structures together.

BACKGROUND ART

A problem is frequently encountered in electrical engineering in connecting planar structures, such as printed-circuit boards, to coaxial structures. The electrical transmission behavior of such connections in many cases however can only be imprecisely determined because the electromagnetic fields of a coaxial structure are quite different from those of a planar circuit board structure. Consequently the impedances in the connection zone deviate from a reference impedance and this condition may result in signal degradation or failure of transmission and power. These problems are compounded for transmissions in the GHz range where even tiny stray losses caused by poor connections may result in substantial decrease in the power output of an electric or electronic apparatus.

Angular connectors for connecting a coaxial structure to a planar structure, such as a conductor board or a planar circuit board, are known. These known angle connectors however cannot be controlled with respect to impedance, that is, the planar-side terminals are not subject to the dimensional guidelines applicable to a waveguide system, such as a microstrip transmission line.

Furthermore probes providing high quality transmission are known in the field of planar measurements. However these known probes are very costly and fail to evince the same electrical properties as pin-and-socket connectors. Therefore, following assembly, the electrical transmission properties of the pin-and-socket connectors do not correspond to the transmission properties measured by the probes.

Accordingly it is the object of the present invention to provide a new and improved very compact simple angle connector having uniform characteristic impedance properties wherein the connector is economical to manufacture and is easily put in place.

SUMMARY OF THE INVENTION

In accordance with one aspect of the invention, an angle connector for electrically connecting a planar structure to a coaxial structure comprises a planar-side terminal on the side of the planar structure. The planar-side terminal can be brought into contact with at least one planar conducting track. A coax-side terminal at the side of the coaxial structure is configured at a given angle to the planar-side terminal and connectable to a coaxial line. The planar-side terminal is designed as a planar waveguide which is connected within an outer periphery of the angle connector to the coax-side terminal. The planar-side terminal is mounted perpendicularly to the coax-side terminal extending within the outer periphery of a housing of said connector.

The planar-side terminal is preferably mounted perpendicularly to the planar structure that can be placed by its end side on the planar structure. The planar-side terminal is mounted on a substrate made of polytetrafluoroethylene. The planar-side terminal has essentially the same width as the conductor strip, at least at the contact site.

The planar-side terminal is in the form of a microstrip transmission line, a triplate transmission line, or a coplanar transmission line. The coax-side terminal is preferably mounted parallel to the planar structure so it is mounted vertically to the planar structure. A screw is preferably mounted to the coaxial structure side to affix the coaxial transmission line.

In accordance with a further aspect of the invention, an angle connector for electrically connecting a planar structure to a coaxial structure comprises a planar-side terminal adapted to contact at least one planar conductor strip. A coax-side terminal mounted at a given angle to the planar-side terminal connectable to a coaxial line is a coaxial waveguide connected within the outer periphery of the angle connector to the coax-side terminal and enclosed by a housing having a radial spacing from the planar structure side terminal which decreases in the direction of the coax-side terminal.

Another aspect of the invention concerns an angle connector for electrically connecting a planar structure to a coaxial structure. The connector comprises a planar-side terminal on the side of the planar structure where the planar-side terminal can be brought into contact with at least one planar conducting track. A coax-side terminal at the side of the coaxial structure is configured at a given angle to the planar-side terminal and connectable to a coaxial line. The coax-side terminal is designed as a planar waveguide which is connected within an outer periphery of the angle connector to the coax-side terminal. The planar-side terminal is a test probe depositable on the conductor strip. The probe preferably has an end with a bevelled contact area. The probe end preferably projects beyond the angle connector housing and includes foot tabs at the planar structure for affixing the angle connector.

The planar-side terminal is thus preferably designed as a planar waveguide connected within the outside circumference of the angle connector to the coax-side terminal.

Therefore the design of the planar-side terminal is identical with or similar to that of a conducting track of the planar structure and the transition from the planar structure to the coaxial structure is shifted to the angle conductor. As a result, a manufacturer of the planar-side terminal fabricates a planar transmission line in accordance with design principles known to optimize the components of the angle connector in such manner that a transmission line having very low reflection is produced, to provide transmission of broadband digital signals in a distortion-free manner. Angle connectors designed in this manner evince very high reflection damping and very low transmission losses.

The angle connector of the invention is very easily constructed in such a way that it makes contact with the associated conductor strip merely by applying pressure. Consequently the angle connector of the invention can be used as a measuring head in test equipment. This feature has the substantial advantage of enabling a user to terminate his circuit with the same output impedance both in the development and manufacturing phases. Therefore a testing technology is made available to the user that corresponds to the actual conditions of the finally built circuit; in other words, using such a probe, the user can terminate the circuit exactly the same way as he otherwise would do by soldering the angle connector.

Advantageously the planar-side terminal is mounted perpendicularly to the planar structure, being affixed on end to said planar structure.

Appropriately the planar-side terminal is mounted on a substrate, preferably made of polytetrafluoreothylene TEFLON.

The connector provides especially advantageous electrical transmission if the planar-side terminal has essentially the same width as the conductor track at least at the site of contact.

Advantageously the entire planar-side terminal is confined within the outside contour of a housing of the angle connector. As a result, on one hand some protection against damage is achieved for the planar-side terminal, and on the other hand, the housing can be so configured that the desired electric and magnetic properties are present in the vicinity of the planar-side terminal.

Moreover the initial problem of the invention is solved by an angle connector wherein the planar-side terminal is designed to be a coaxial waveguide connected within the outside circumference of the angle connector with the coax-side terminal and enclosed by a housing having a radial distance to the planar-side terminal that decreases in the direction of the coax-side terminal.

In this case the connection between the planar-side terminal and the coax-side terminal is shifted to the inside of the angle connector. Thereby the radial distance between the planar-side terminal and the housing and the angle at which the planar-side terminal is mounted on the planar structure can be optimized in such manner that the desired matching of the electromagnetic wave is achieved throughout the entire region of the angle connector.

The angle connector of the invention is constructed so signal transmission though it results in low lead stray fields, a feature of special importance for digital signals. For transmission of analogue and digital signals the angle connectors of the invention offer excellent impedance matching over a wide frequency range from DC to microwaves for transmission of analogue and digital signals. Furthermore, the angle connector of the invention is designed in such manner that a connection can be made in the planar-side terminal merely by pressing on it. This feature enables the angle connector to be used as a probe in mechanical positioning systems. Thereby, probes are made available which evince nearly the same electrical properties as the angle connectors to be affixed to the planar structure.

Reliable connection of the angle connector and the coaxial transmission line is achieved by providing a screw or clamp for fitting an end zone of the coaxial structure side to a coaxial transmission line.

Advantageously the planar-side terminal is designed to be a probe to be deposited on a conductor strip. Because such probes—as already mentioned—have nearly the same electrical properties as the angle connectors subsequently affixed to the planar structure, the electrical behavior of the overall planar structure can be very accurately determined beforehand.

The invention is elucidated below in illustrative manner and in relation to the drawings.

DESCRIPTION OF THE PREFERRED EMBODIMENT

Figure 1:
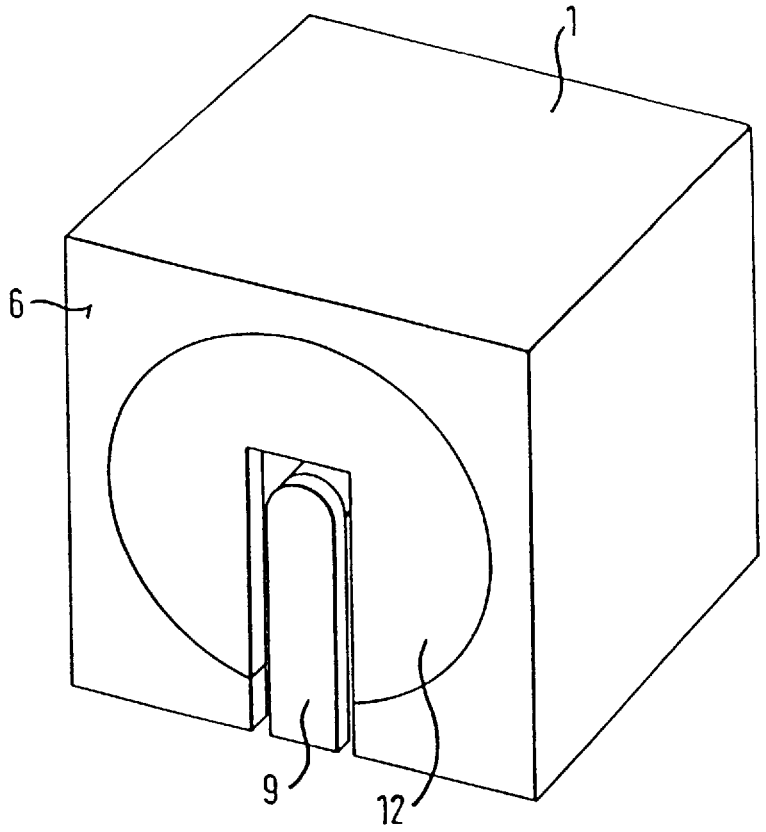
FIG. 1 is a perspective view of a first preferred embodiment of an angle connector of the invention.
Figure 2:
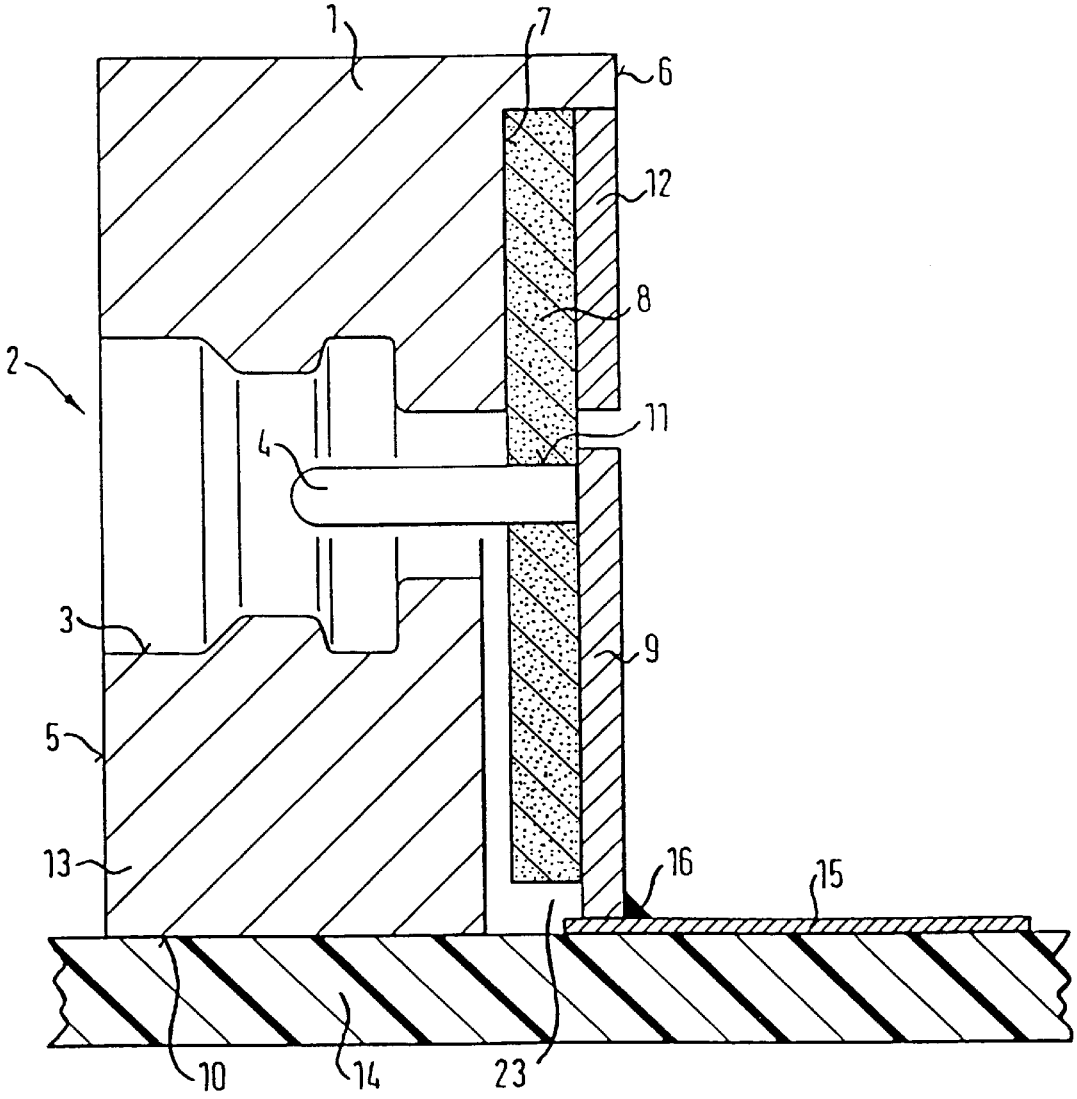
FIG. 2 is a vertical and central longitudinal sectional view of the angle connector of FIG. 1 together with the printed board mounted underneath it.

As shown in FIGS. 1 and 2 of the drawing, a first preferred embodiment of the angle connector comprises a substantially cubic housing 1 having a coaxial terminal 2. The coaxial terminal 2 comprises a horizontally stepped coaxial bore 3 centrally located in the housing 1. Horizontally extending coax-side terminal 4, formed as a pin, enters bore 3. The coaxial terminal 2 is open toward the rear side 5 of the housing 1. When a known type of coaxial connector is inserted into the coaxial borehole 3, pin 4 contacts the inner conductor of the inserted coaxial connector.

The front side 6 of housing 1 comprises a recess 7 into which is placed a vertically extending, planar substrate 8. Planar vertically extending terminal 9, in the form of a conductor strip, is mounted on substrate 8 to extend upwardly from the vicinity of the base 10 of housing 1 slightly beyond pin 4. Pin 4 and terminal 9 abut and are electrically connected to each other.

Pin 4, after passing through horizontal bore 11 of substrate 8, is connected to the planar terminal 9.

The portions of substrate 8 not covered by planar terminal 9 are covered by cover 12.

The planar terminal 9 and substrate 8, preferably TEFLON (polytetrafluoroethylene), form a planar wave guide.

In the embodiment of FIG. 2 the electromagnetic waves are guided only in a coplanar manner, since the lower part 13 of the housing 1 is spaced slightly from substrate 8. If housing 1 were symmetrical, that is, if the lower part of the housing 13 were to join the substrate 8, a triplate guide or a microstrip transmission line would be formed.

The angle connector shown in FIG. 2 is designed so it can be deposited on a planar structure in the form of a printed-circuit board 14. In the assembled state of the angle connector, the planar terminal at one of its edges rests on a conductor strip 15 of the printed-circuit board 14 and is electrically connected by solder 16 to the conductor strip 15. Substrate 8, on the other hand, does not extend to or contact conductor strip 15, whereby a free insulation space 23 subsists between the lower edge of insulating substrate 8 and printed-circuit board 14, as well as conductor strip 14, as shown in FIG. 2. Thereby conductor strip 15 can protrude into free space 23.

It is important that the planar terminal of the angle connector, that is the planar terminal 9 and the substrate 8 under it, be manufactured as a planar transmission line. Such a line is illustratively a microstrip transmission line, coplanar lines or triplate lines.

Figure 3:
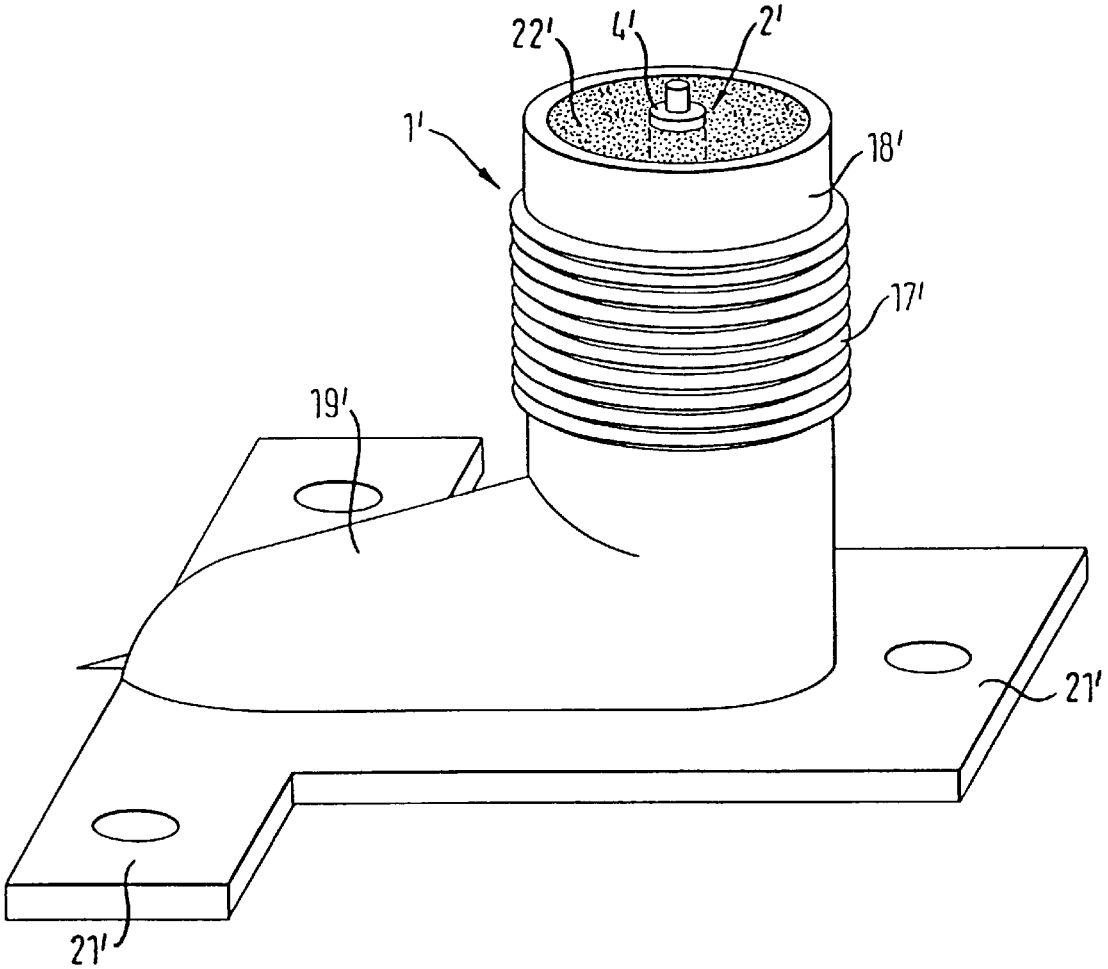
FIG. 3 is a perspective view of a second preferred embodiment of an angle connector of the invention.
Figure 4:
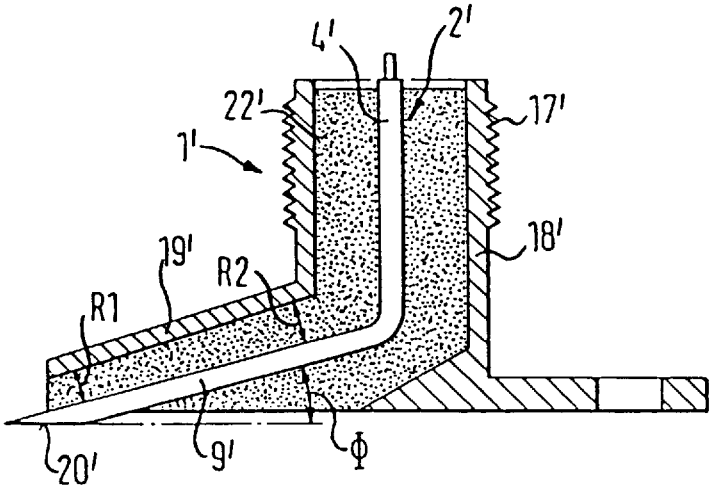
FIG. 4 is a vertical longitudinal sectional view of the angle connector of FIG. 2.
Figure 5:
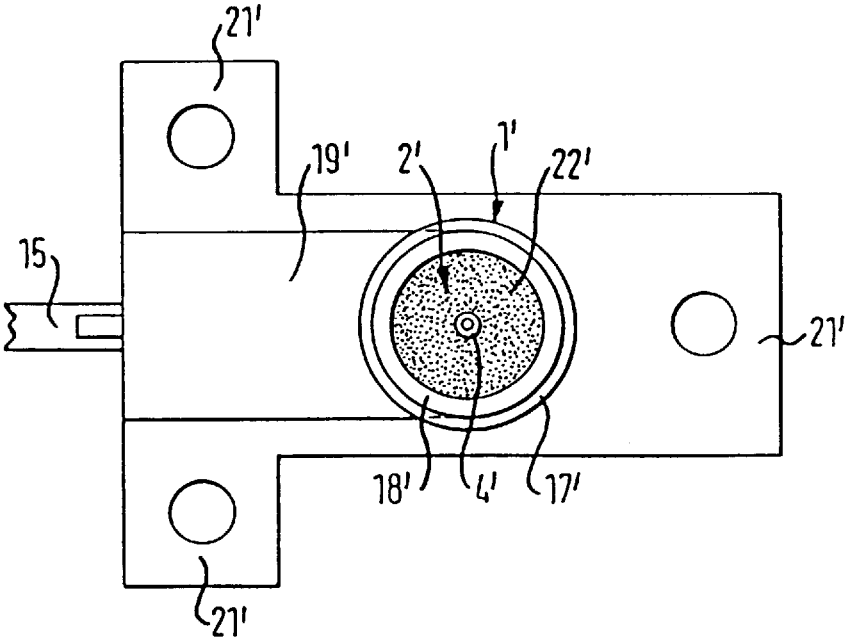
FIG. 5 is a top view of the angle connector of FIG. 2.

In the modified embodiment of the angle connector shown in FIGS. 3 through 5, coaxial terminal 2' extends vertically to enable a coaxial connector (not shown) to be plugged vertically to a printed board (not shown) on the coaxial terminal 2'.

The housing 1' comprises a vertical, hollow cylindrical part 18' fitted with an outer thread 17' on its outer circumference to secure the coaxial plug.

The vertical part 18' of the housing 1' merges into a segment 19' mounted at an acute angle to the horizontal plane. Thereby segment 19' forms an essentially horizontally extending tube which runs inside the waveguide terminal 9' (FIG. 4) on the side of the planar structure. The radial spacing R1 between the front end of the planar-side terminal 9' and the segment 19' of the housing 1' is less than the radial spacing R2 between the planar-side terminal 9' and the housing 1' in the zone merging into the cylindrical hollow part 18'. The geometric layout of the distances R1, R2 and angle ○ between the planar-side terminal 9' and the horizontal plane is such manner that matching the electromagnetic wave is assured in the entire region of the angle connector.

In this embodiment, both the coaxial inner conductor 4' and the terminal 9' on the planar-structure side are designed as a coaxial cable that tapers to have a controlled impedance.

When the angle connector shown in FIGS. 3 through 5 is fitted to test equipment and used as a probe, the free end of terminal 9' on the planar-structure side is mounted in such manner that by simply pressing the angle connector against a conductor strip the free end contacts the strip. To this end, the end of terminal 9' on the planar-structure side slightly projects beyond housing 1' and comprises a bevelled contact area 20' at its underside.

When the angle connector is used as an angle connector means, laterally projecting tabs 21' include suitable holes to pass affixing elements that are secured in the base region.

Moreover a dielectric filler 22' is provided between the coaxial inner conductor 4' or between the coax-side terminal 4' and the housing 1'. Filler 22' can be replaced by a so-called insulated support.

Figure 6:
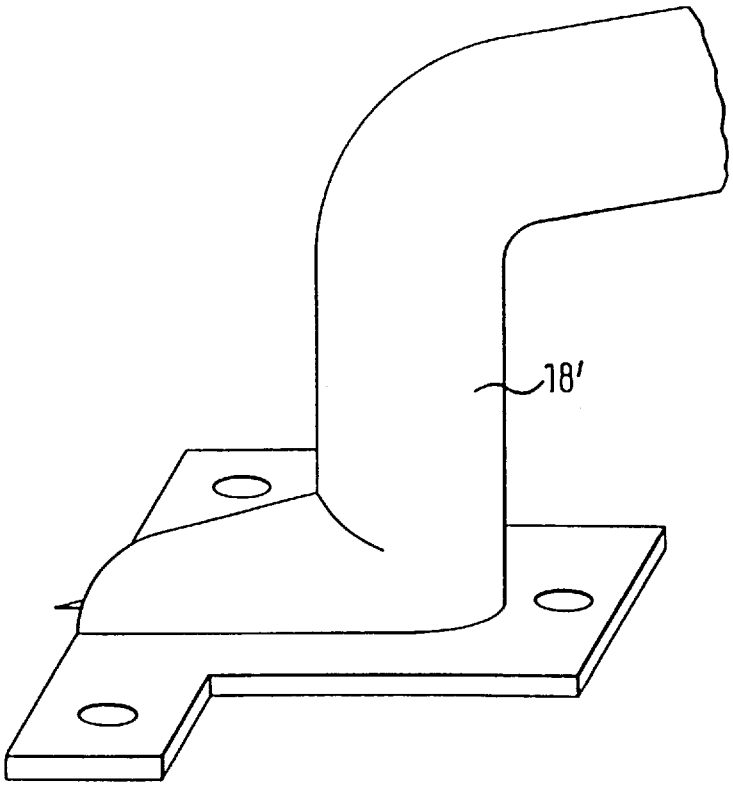
FIG. 6 is a perspective view of a third preferred embodiment of the angle connector of the invention.

The third embodiment of the angle connector shown in FIG. 6 differs from that shown in FIGS. 3 through 5 in that the vertical, hollow cylindrical part 18' of the housing 1' has a bend toward its free upper end in the horizontal direction, whereby the coaxial terminal runs substantially horizontally. Such a construction enables the coaxial connector to be plugged-in to a structure that is essentially parallel to a printed-circuit board.

While there have been described and illustrated specific embodiments of the invention, it will be clear that variations in the details of the embodiments specifically illustrated and described may be made without departing from the true spirit and scope of the invention as defined in the appended claims.

I claim:

1. An angle connector for electrically connecting a planar structure to a coaxial structure, comprising a planar-side terminal on the side of the planar structure where said planar-side terminal can be brought into contact with at least one planar conducting track, a coax-side terminal at the side of the coaxial structure, the coax-side terminal being configured at a given angle to the planar-side terminal and connectable to a coaxial line, the planar-side terminal being designed as a planar waveguide which is connected within an outer periphery of the angle connector to the coax-side terminal, the planar-side terminal being mounted perpendicularly to the coax-side terminal and extending within the outer periphery of a housing of said connector.

2. Angle connector as claimed in claim 1, wherein the planar-side terminal is mounted perpendicularly to the planar structure.

3. Angle connector as claimed in claim 1, wherein the planar-side terminal can be placed by its end side on the planar structure.

4. Angle connector as claimed in claim 1, wherein the planar-side terminal is mounted on a substrate made of polytetrafluoroethylene.

5. Angle connector as claimed in claim 1, wherein the planar-side terminal evinces essentially the same width as the conductor strip at least at the contact site.

6. Angle connector as claimed in claim 1, wherein the planar-side terminal is in the form of a microstrip transmission line.

7. Angle connector as claimed in claim 1 wherein the coax-side terminal is mounted parallel to the planar structure.

8. Angle connector as claimed in claim 1 wherein the coax-side terminal is mounted vertically to the planar structure.

9. Angle connector as claimed in claim 1 wherein a screw is mounted to the coaxial structure side to affix the coaxial transmission line.

10. Angle connector as claimed in claim 1 further including foot tabs at the planar structure for affixing the angle connector.

11. Angle connector as claimed in claim 1, wherein the planar-side terminal is in the form of a triplate transmission line.

12. Angle connector as claimed in claim 1, wherein the planar-side terminal is in the form of a coplanar transmission line.

13. Angle connector as claimed in claim 1 wherein a clamp fitting is mounted to the coaxial structure side to affix the coaxial transmission line.

14. An angle connector for electrically connecting a planar structure to a coaxial structure, comprising a planar-side terminal on the side of the planar structure where said planar-side terminal can be brought into contact with at least one planar conducting track, a coax-side terminal at the side of the coaxial structure, the coax-side terminal being configured at a given angle to the planar-side terminal and connectable to a coaxial line, to the planar-side terminal being designed as a planar waveguide which is connected within an outer periphery of the angle connector to the coax-side terminal, the planar-side terminal being a test probe depositable on the conductor strip.

15. Angle connector as claimed in claim 14 wherein the probe comprises an end with a bevelled contact area.

16. Angle connector as claimed in claim 14 wherein the probe end projects beyond the angle connector housing.

17. An angle connector for electrically connecting a planar structure to a coaxial structure, comprising a planar-side terminal on the side of the planar structure, adapted to contact at least one planar conductor strip and a coax-side terminal on the side of the coaxial structure, the coax-side terminal being mounted at a given angle to said planar-side terminal and connectable to a coaxial line, the planar-side terminal being a coaxial waveguide connected within the outer periphery of the angle connector to the coax-side terminal and enclosed by a housing having a radial spacing from the planar structure side terminal which decreases in the direction of the coax-side terminal.

* * * * *